US007711133B2

(12) United States Patent
Goorevich et al.

(10) Patent No.: US 7,711,133 B2
(45) Date of Patent: May 4, 2010

(54) SELECTIVE RESOLUTION SPEECH PROCESSING

(75) Inventors: Michael Goorevich, Lane Cove (AU); Andrew Vandali, Lane Cove (AU)

(73) Assignee: Hearworks Pty Limited, East Melbourne (AU)

( * ) Notice: Subject to any disclaimer, the term of this patent is extended or adjusted under 35 U.S.C. 154(b) by 1345 days.

(21) Appl. No.: 11/167,283

(22) Filed: Jun. 28, 2005

(65) Prior Publication Data

US 2006/0013422 A1 Jan. 19, 2006

Related U.S. Application Data

(60) Provisional application No. 60/583,013, filed on Jun. 28, 2004.

(51) Int. Cl.
*H04R 25/00* (2006.01)

(52) U.S. Cl. ..... 381/316; 381/320; 381/98

(58) Field of Classification Search ..... 381/312, 381/316, 320, 98, 314, 321, 101, 60; 700/94; 704/200, 205, 268
See application file for complete search history.

(56) References Cited

U.S. PATENT DOCUMENTS 4,454,609 A * 6/1984 Kates ..... 381/320
5,613,008 A * 3/1997 Martin ..... 381/314
6,236,731 B1 * 5/2001 Brennan et al. ..... 381/316
6,308,155 B1 * 10/2001 Kingsbury et al. ..... 704/256.1
6,537,200 B2 3/2003 Leysieffer et al.
6,575,894 B2 6/2003 Leysieffer et al.
6,697,674 B2 2/2004 Leysieffer
6,732,073 B1 * 5/2004 Kluender et al. ..... 704/233
7,076,315 B1 * 7/2006 Watts ..... 700/94
7,321,662 B2 * 1/2008 Lundh et al. ..... 381/314

FOREIGN PATENT DOCUMENTS

WO WO 02/17679 2/2002

* cited by examiner

*Primary Examiner*—Vivian Chin
*Assistant Examiner*—Jason R Kurr
(74) *Attorney, Agent, or Firm*—Connolly Bove Lodge & Hutz LLP

(57) ABSTRACT

A hearing prosthesis, including receiver means for receiving a signal representative of a signal over a frequency range; a first filter bank, having a relatively higher resolution, adapted to process said received signal and produce a first set of channel outputs relating to a selected region or regions of said frequency range; and a second filter bank having a relatively lower resolution, adapted to process said received signal and produce a second set of channel outputs relating to at least the rest of said frequency range; combination means to combine the first and second sets of channel outputs, and processing means operative upon the combined outputs so as to produce a set of stimulation signals for said hearing prosthesis.

16 Claims, 20 Drawing Sheets

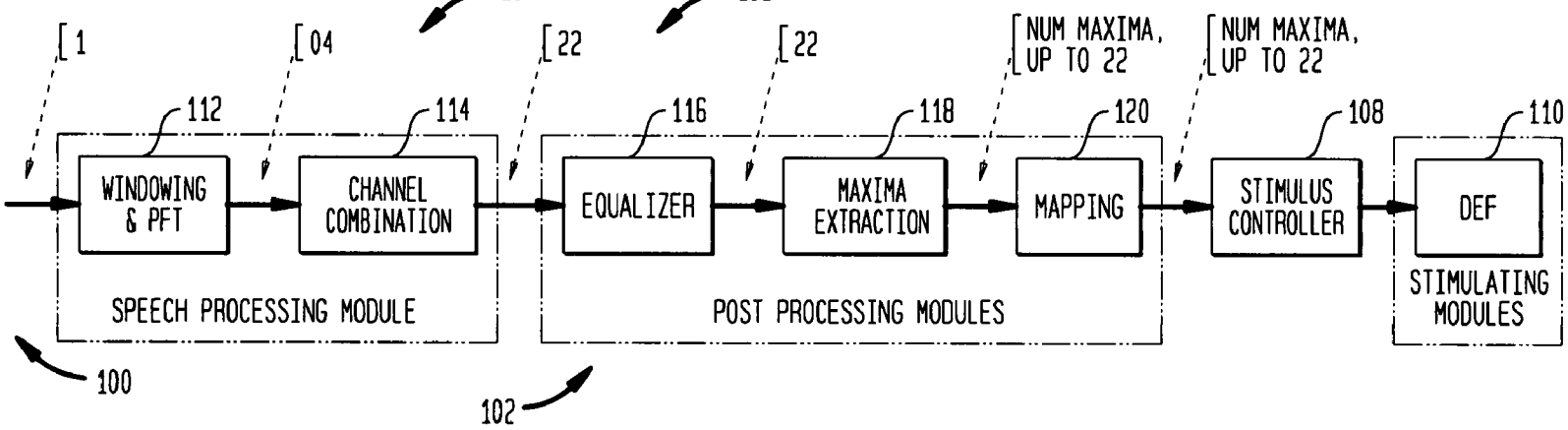
FIG. 1
100
102
104
106
1
04
22
22
112
WINDOWING & PFT
114
CHANNEL COMBINATION
116
EQUALIZER
118
MAXIMA EXTRACTION
120
MAPPING
108
STIMULUS CONTROLLER
110
DEF
NUM MAXIMA, UP TO 22
NUM MAXIMA, UP TO 22
SPEECH PROCESSING MODULE
POST PROCESSING MODULES
STIMULATING MODULES

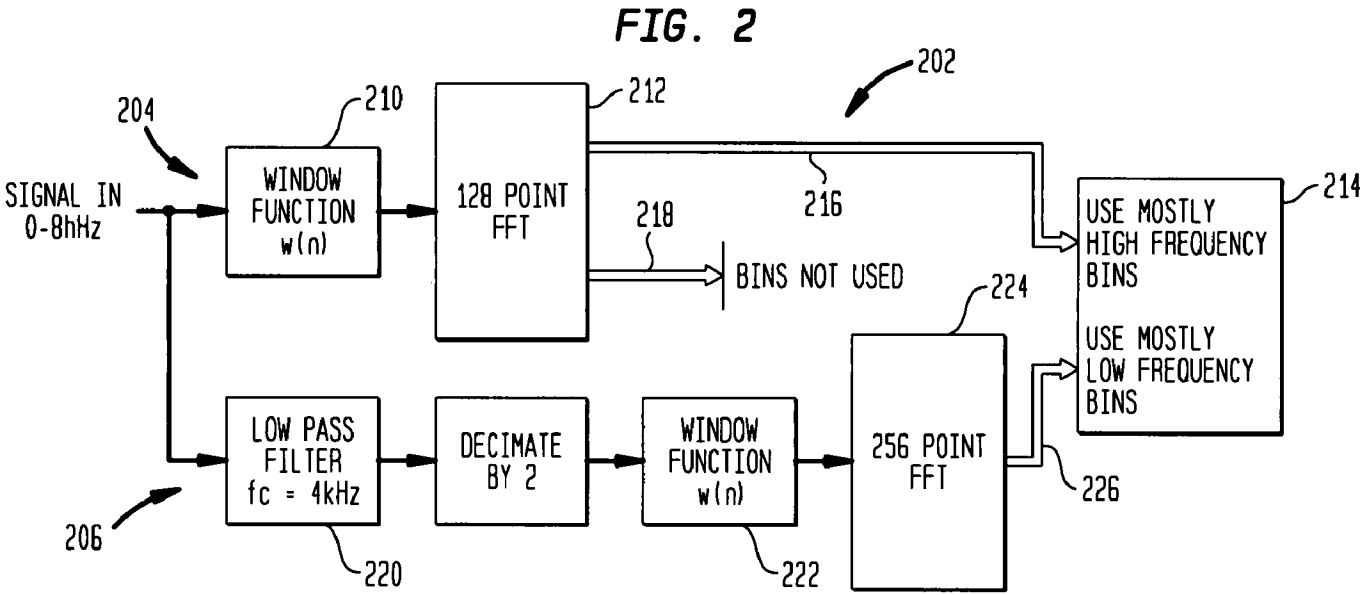
FIG. 2
202
204
206
SIGNAL IN 0-8hHz
210
WINDOW FUNCTION w(n)
212
128 POINT FFT
218
BINS NOT USED
216
214
USE MOSTLY HIGH FREQUENCY BINS
USE MOSTLY LOW FREQUENCY BINS
220
LOW PASS FILTER fc = 4kHz
222
DECIMATE BY 2
224
WINDOW FUNCTION w(n)
226
256 POINT FFT SPECTRUM OF SYNTHETIC VOWEL "a" WITH FUNDAMENTAL = 130Hz SPECTRUM OF SYNTHETIC VOWEL "a" WITH FUNDAMENTAL = 180Hz

TWO SYNTHETIC VOWELS PASSED THROUGH 22 CHANNEL ACE

TWO SYNTHETIC VOWELS "a" WITH 128 pt FFT

TWO SYNTHETIC VOWELS "a" WITH 256 pt FFT

TWO SYNTHETIC VOWELS 'a' WITH 512 pt FFT

HARMONIC EMPHASIS FILTERBANK vs SPRINT FAT 6

FIG. 13A

| 128 pt | 256 pt | FFT | CHANNEL |
|---|---|---|---|
| 0.00 | 0.00 | 0 | 0 |
| 0.00 | 31.25 | 0 | 0 |
| 0.00 | 62.50 | 0 | 0 |
| 0.00 | 93.75 | 2 | 1 |
| 125.00 | 125.00 | 0 | 1 |
| 0.00 | 156.25 | 0 | 1 |
| 0.00 | 187.50 | 0 | 1 |
| 0.00 | 218.75 | 0 | 1 |
| 250.00 | 250.00 | 2 | 2 |
| 0.00 | 281.25 | 0 | 2 |
| 0.00 | 312.50 | 0 | 2 |
| 0.00 | 343.75 | 0 | 2 |
| 375.00 | 375.00 | 0 | 2 |
| 0.00 | 406.25 | 2 | 3 |
| 0.00 | 437.50 | 2 | 4 |
| 0.00 | 468.75 | 2 | 5 |
| 500.0 | 500.00 | 2 | 6 |
| 0.00 | 531.25 | 2 | 7 |
| 0.00 | 562.50 | 2 | 8 |
| 0.00 | 593.75 | 2 | 9 |
| 625.00 | 625.00 | 2 | 10 |
| 0.00 | 656.25 | 2 | 11 |
| 0.00 | 687.50 | 2 | 12 |

FIG. 13B

| 128 pt | 256 pt | FFT | CHANNEL |
|---|---|---|---|
| 0.00 | 718.75 | 2 | 13 |
| 750.00 | 750.00 | 2 | 14 |
| 0.00 | 781.25 | 2 | 15 |
| 0.00 | 812.50 | 2 | 16 |
| 0.00 | 843.75 | 0 | 16 |
| 875.00 | 875.00 | 0 | 16 |
| 0.00 | 906.25 | 2 | 17 |
| 0.00 | 937.50 | 0 | 17 |
| 0.00 | 968.75 | 0 | 17 |
| 1000.00 | 1000.00 | 2 | 18 |
| 0.00 | 1031.25 | 0 | 18 |
| 0.00 | 1062.50 | 0 | 18 |
| 0.00 | 1093.75 | 2 | 19 |
| 1125.00 | 1125.00 | 0 | 19 |
| 0.00 | 1156.25 | 0 | 19 |
| 0.00 | 1187.50 | 2 | 20 |
| 0.00 | 1218.75 | 0 | 20 |
| 1250.00 | 1250.00 | 0 | 20 |
| 0.00 | 1281.25 | 0 | 20 |
| 0.00 | 1312.50 | 2 | 21 |
| 0.00 | 1343.75 | 0 | 21 |
| 1375.00 | 1375.00 | 0 | 21 |
| 0.00 | 1406.25 | 0 | 21 |
| 0.00 | 1437.50 | 2 | 22 |
| 0.00 | 1468.75 | 0 | 22 |
| 1500.00 | 1500.00 | 0 | 22 |
| 0.00 | 1531.25 | 0 | 22 |
| 0.00 | 1562.50 | 2 | 23 |

FIG. 13C

| 128 pt | 256 pt | FFT | CHANNEL |
|---|---|---|---|
| 0.00 | 1593.75 | 0 | 23 |
| 1625.00 | 1625.00 | 0 | 23 |
| 0.00 | 1656.25 | 0 | 23 |
| 0.00 | 1687.50 | 0 | 23 |
| 0.00 | 1718.75 | 2 | 24 |
| 1750.00 | 1750.00 | 0 | 24 |
| 0.00 | 1781.25 | 0 | 24 |
| 0.00 | 1812.50 | 0 | 24 |
| 0.00 | 1843.75 | 2 | 25 |
| 1875.00 | 1875.00 | 0 | 25 |
| 0.00 | 1906.25 | 0 | 25 |
| 0.00 | 1937.50 | 0 | 25 |
| 0.00 | 1968.75 | 0 | 25 |
| 2000.00 | 2000.00 | 2 | 26 |
| 0.00 | 2031.25 | 0 | 26 |
| 0.00 | 2062.50 | 0 | 26 |
| 0.00 | 2093.75 | 0 | 26 |
| 2125.00 | 2125.00 | 0 | 26 |
| 0.00 | 2156.25 | 0 | 26 |
| 0.00 | 2187.50 | 2 | 27 |
| 0.00 | 2218.75 | 0 | 27 |
| 2250.00 | 2250.00 | 0 | 27 |
| 0.00 | 2281.25 | 0 | 27 |
| 0.00 | 2312.50 | 0 | 27 |
| 0.00 | 2343.75 | 0 | 27 |
| 2375.00 | 2375.00 | 2 | 28 |
| 0.00 | 2406.25 | 0 | 28 |
| 0.00 | 2437.50 | 0 | 28 |

FIG. 13D

| 128 pt | 256 pt | FFT | CHANNEL |
|---|---|---|---|
| 0.00 | 2468.75 | 0 | 28 |
| 2500.00 | 2500.00 | 0 | 28 |
| 0.00 | 2531.25 | 0 | 28 |
| 0.00 | 2562.50 | 2 | 29 |
| 0.00 | 2593.75 | 0 | 29 |
| 2625.00 | 2625.00 | 0 | 29 |
| 0.00 | 2656.25 | 0 | 29 |
| 0.00 | 2687.50 | 0 | 29 |
| 0.00 | 2718.75 | 0 | 29 |
| 2750.00 | 2750.00 | 2 | 30 |
| 0.00 | 2781.25 | 0 | 30 |
| 0.00 | 2812.50 | 0 | 30 |
| 0.00 | 2843.75 | 0 | 30 |
| 2875.00 | 2875.00 | 0 | 30 |
| 0.00 | 2906.25 | 0 | 30 |
| 0.00 | 2937.50 | 0 | 30 |
| 0.00 | 2968.75 | 2 | 31 |
| 3000.00 | 3000.00 | 0 | 31 |
| 0.00 | 3031.25 | 0 | 31 |
| 0.00 | 3062.50 | 0 | 31 |
| 0.00 | 3093.75 | 0 | 31 |
| 3125.00 | 3125.00 | 0 | 31 |
| 0.00 | 3156.25 | 0 | 31 |
| 0.00 | 3187.50 | 0 | 31 |
| 0.00 | 3218.75 | 2 | 32 |
| 3250.00 | 3250.00 | 0 | 32 |
| 0.00 | 3281.25 | 0 | 32 |
| 0.00 | 3312.50 | 0 | 32 |

FIG. 13E

| 128 pt | 256 pt | FFT | CHANNEL |
|---|---|---|---|
| 0.00 | 3343.75 | 0 | 32 |
| 3375.00 | 3375.00 | 0 | 32 |
| 0.00 | 3406.25 | 0 | 32 |
| 0.00 | 3437.50 | 0 | 32 |
| 0.00 | 3468.75 | 2 | 33 |
| 3500.00 | 3500.00 | 0 | 33 |
| 0.00 | 3531.25 | 0 | 33 |
| 0.00 | 3562.50 | 0 | 33 |
| 0.00 | 3593.75 | 0 | 33 |
| 3625.00 | 3625.00 | 0 | 33 |
| 0.00 | 3656.25 | 0 | 33 |
| 0.00 | 3687.50 | 0 | 33 |
| 0.00 | 3718.75 | 2 | 34 |
| 3750.00 | 3750.00 | 0 | 34 |
| 0.00 | 3781.25 | 0 | 34 |
| 0.00 | 3812.50 | 0 | 34 |
| 0.00 | 3843.75 | 0 | 34 |
| 3875.00 | 3875.00 | 0 | 34 |
| 0.00 | 3906.25 | 0 | 34 |
| 0.00 | 3937.50 | 0 | 34 |
| 0.00 | 3968.75 | 0 | 34 |
| 4000.00 | 0.00 | 1 | 35 |
| 0.00 | 0.00 | 0 | 35 |
| 0.00 | 0.00 | 0 | 35 |
| 0.00 | 0.00 | 0 | 35 |
| 4125.00 | 0.00 | 0 | 35 |
| 0.00 | 0.00 | 0 | 35 |
| 0.00 | 0.00 | 0 | 35 |

FIG. 13F

| 128 pt | 256 pt | FFT | CHANNEL |
|---|---|---|---|
| 0.00 | 0.00 | 0 | 35 |
| 4250.00 | 0.00 | 1 | 36 |
| 0.00 | 0.00 | 0 | 36 |
| 0.00 | 0.00 | 0 | 36 |
| 0.00 | 0.00 | 0 | 36 |
| 4375.00 | 0.00 | 0 | 36 |
| 0.00 | 0.00 | 0 | 36 |
| 0.00 | 0.00 | 0 | 36 |
| 0.00 | 0.00 | 0 | 36 |
| 4500.00 | 0.00 | 1 | 37 |
| 0.00 | 0.00 | 0 | 37 |
| 0.00 | 0.00 | 0 | 37 |
| 0.00 | 0.00 | 0 | 37 |
| 4625.00 | 0.00 | 0 | 37 |
| 0.00 | 0.00 | 0 | 37 |
| 0.00 | 0.00 | 0 | 37 |
| 0.00 | 0.00 | 0 | 37 |
| 4750.00 | 0.00 | 0 | 37 |
| 0.00 | 0.00 | 0 | 37 |
| 0.00 | 0.00 | 0 | 37 |
| 0.00 | 0.00 | 0 | 37 |
| 4875.00 | 0.00 | 1 | 38 |
| 0.00 | 0.00 | 0 | 38 |
| 0.00 | 0.00 | 0 | 38 |
| 0.00 | 0.00 | 0 | 38 |
| 5000.00 | 0.00 | 0 | 38 |
| 0.00 | 0.00 | 0 | 38 |

FIG. 13G

| 128 pt | 256 pt | FFT | CHANNEL |
|---|---|---|---|
| 0.00 | 0.00 | 0 | 38 |
| 0.00 | 0.00 | 0 | 38 |
| 5125.00 | 0.00 | 0 | 38 |
| 0.00 | 0.00 | 0 | 38 |
| 0.00 | 0.00 | 0 | 38 |
| 0.00 | 0.00 | 0 | 38 |
| 5250.00 | 0.00 | 1 | 39 |
| 0.00 | 0.00 | 0 | 39 |
| 0.00 | 0.00 | 0 | 39 |
| 0.00 | 0.00 | 0 | 39 |
| 5375.00 | 0.00 | 0 | 39 |
| 0.00 | 0.00 | 0 | 39 |
| 0.00 | 0.00 | 0 | 39 |
| 0.00 | 0.00 | 0 | 39 |
| 5500.00 | 0.00 | 0 | 39 |
| 0.00 | 0.00 | 0 | 39 |
| 0.00 | 0.00 | 0 | 39 |
| 0.00 | 0.00 | 0 | 39 |
| 5625.00 | 0.00 | 1 | 40 |
| 0.00 | 0.00 | 0 | 40 |
| 0.00 | 0.00 | 0 | 40 |
| 0.00 | 0.00 | 0 | 40 |
| 5750.00 | 0.00 | 0 | 40 |
| 0.00 | 0.00 | 0 | 40 |
| 0.00 | 0.00 | 0 | 40 |
| 0.00 | 0.00 | 0 | 40 |
| 5875.00 | 0.00 | 0 | 40 |
| 0.00 | 0.00 | 0 | 40 |

FIG. 13H

| 128 pt | 256 pt | FFT | CHANNEL |
|---|---|---|---|
| 0.00 | 0.00 | 0 | 40 |
| 0.00 | 0.00 | 0 | 40 |
| 6000.00 | 0.00 | 1 | 41 |
| 0.00 | 0.00 | 0 | 41 |
| 0.00 | 0.00 | 0 | 41 |
| 0.00 | 0.00 | 0 | 41 |
| 6125.00 | 0.00 | 0 | 41 |
| 0.00 | 0.00 | 0 | 41 |
| 0.00 | 0.00 | 0 | 41 |
| 0.00 | 0.00 | 0 | 41 |
| 6250.00 | 0.00 | 0 | 41 |
| 0.00 | 0.00 | 0 | 41 |
| 0.00 | 0.00 | 0 | 41 |
| 0.00 | 0.00 | 0 | 41 |
| 6375.00 | 0.00 | 0 | 41 |
| 0.00 | 0.00 | 0 | 41 |
| 0.00 | 0.00 | 0 | 41 |
| 0.00 | 0.00 | 0 | 41 |
| 6500.00 | 0.00 | 1 | 42 |
| 0.00 | 0.00 | 0 | 42 |
| 0.00 | 0.00 | 0 | 42 |
| 0.00 | 0.00 | 0 | 42 |
| 6625.00 | 0.00 | 0 | 42 |
| 0.00 | 0.00 | 0 | 42 |
| 0.00 | 0.00 | 0 | 42 |
| 0.00 | 0.00 | 0 | 42 |
| 6750.00 | 0.00 | 0 | 42 |
| 0.00 | 0.00 | 0 | 42 |

FIG. 13I

| 128 pt | 256 pt | FFT | CHANNEL |
|---|---|---|---|
| 0.00 | 0.00 | 0 | 42 |
| 0.00 | 0.00 | 0 | 42 |
| 6875.00 | 0.00 | 0 | 42 |
| 0.00 | 0.00 | 0 | 42 |
| 0.00 | 0.00 | 0 | 42 |
| 0.00 | 0.00 | 0 | 42 |
| 7000.00 | 0.00 | 1 | 43 |
| 0.00 | 0.00 | 0 | 43 |
| 0.00 | 0.00 | 0 | 43 |
| 0.00 | 0.00 | 0 | 43 |
| 7125.00 | 0.00 | 0 | 43 |
| 0.00 | 0.00 | 0 | 43 |
| 0.00 | 0.00 | 0 | 43 |
| 0.00 | 0.00 | 0 | 43 |
| 7250.00 | 0.00 | 0 | 43 |
| 0.00 | 0.00 | 0 | 43 |
| 0.00 | 0.00 | 0 | 43 |
| 0.00 | 0.00 | 0 | 43 |
| 7375.00 | 0.00 | 0 | 43 |
| 0.00 | 0.00 | 0 | 43 |
| 0.00 | 0.00 | 0 | 43 |
| 0.00 | 0.00 | 0 | 43 |
| 7500.00 | 0.00 | 0 | 43 |
| 0.00 | 0.00 | 0 | 43 |
| 0.00 | 0.00 | 0 | 43 |
| 0.00 | 0.00 | 0 | 43 |
| 7625.00 | 0.00 | 0 | 43 |
| 0.00 | 0.00 | 0 | 43 |

FIG. 13J

| 128 pt | 256 pt | FFT | CHANNEL |
|---|---|---|---|
| 0.00 | 0.00 | 0 | 43 |
| 0.00 | 0.00 | 0 | 43 |
| 7750.00 | 0.00 | 0 | 43 |
| 0.00 | 0.00 | 0 | 43 |
| 0.00 | 0.00 | 0 | 43 |
| 0.00 | 0.00 | 0 | 43 |
| 7875.00 | 0.00 | 0 | 43 |
| 0.00 | 0.00 | 0 | 43 |
| 0.00 | 0.00 | 0 | 43 |
| 0.00 | 0.00 | 0 | 43 |

SELECTIVE RESOLUTION SPEECH PROCESSING

CROSS-REFERENCE TO RELATED APPLICATIONS

This application makes reference to and claims the priority of U.S. Provisional Patent Application No. 60/583,013, entitled, "Harmonic Emphasis Filterbank," filed Jun. 28, 2004. The entire disclosure and contents of the above applications are hereby incorporated by reference.

BACKGROUND

1. Field of the Invention

The present invention relates generally to signal and speech processing for coding strategies in medical devices, and more particularly, to hearing prostheses such as cochlear implants.

2. Related Art

There are several electrical stimulation devices that use an electrical signal to stimulate nerve, tissue or muscle fibers in a user. Cochlear™ implants and similar hearing devices apply a stimulating signal to the cochlea of the ear to stimulate a percept of hearing. More particularly, these systems include a microphone that receives ambient sounds, a signal processor that converts selected sounds according to a speech coding strategy into corresponding stimulating signals, and an implanted electrode array for delivering stimuli to the recipient. The recipient (also referred to as a patient herein) receives a perception of hearing based on the nerve stimulation.

Although hearing implants have been widely used, there is an on-going need to improve the fidelity of speech and sound percepts which are experienced by the users.

SUMMARY

The present invention recognizes that certain areas of the hearing frequency range are of more significance than others to speech perception. Accordingly, instead of employing a conventional approach of generally equally-spaced analysis channels, aspects of the present invention provide more closely spaced analysis channels in one or more regions of the hearing frequency range, thereby providing higher spectral resolution in those selected regions. According to one aspect of the present invention, there is provided a hearing prosthesis, including receiver means for receiving a signal representative of a sound signal over a frequency range; a first filter bank, having a relatively higher resolution, adapted to process said received signal and produce a first set of channel outputs relating to a selected region or regions of said frequency range; and a second filter bank having a relatively lower resolution, adapted to process said received signal and produce a second set of channel outputs relating to at least the rest of said frequency range; combination means to combine the first and second sets of channel outputs, and processing means operative upon the combined outputs so as to produce a set of stimulation signals for said hearing prosthesis.

According to another aspect of the present invention, there is provided a process for emphasizing at least one region of speech comprising first means for filtering in an emphasized speech region to generate a high resolution output, second means for filtering below and above the emphasized speech region to generate a low resolution output, and means for combining the high and low resolution outputs into a stimulating signal. The stimulating signal may be sent along an electrode or electrode array to stimulate one or more nerves.

According to another aspect of the present invention, there is provided a method for processing sound signals for use in a hearing prosthesis, said method comprising: receiving a signal representative of a sound signal over a frequency range; applying a first filter bank, having a relatively higher resolution, to a selected region or regions of said frequency range to produce a first set of channel outputs; applying a second filter bank, having a relatively lower resolution, to the rest of said frequency range to produce a second set of channel outputs; and combining the first and second sets of channel outputs, and processing the combined outputs so as to produce a set of stimulation signals for said hearing prosthesis.

The present invention may also be applied to other neural stimulation applications, so that higher spectral resolution is provided in some regions of interest than in the broader frequency range of interest.

BRIEF DESCRIPTION OF THE DRAWINGS

The invention will be described in conjunction with the accompanying drawings, in which:

FIG. 1 shows a block diagram of a conventional speech processor;

FIG. 2 shows a block diagram of a dual channel filterbank according to an embodiment of the present invention;

FIGS. 13A-13J depict a bin allocation table for the use of two FFT outputs in accordance with one embodiment of the present invention.

DETAILED DESCRIPTION

Figure 3:
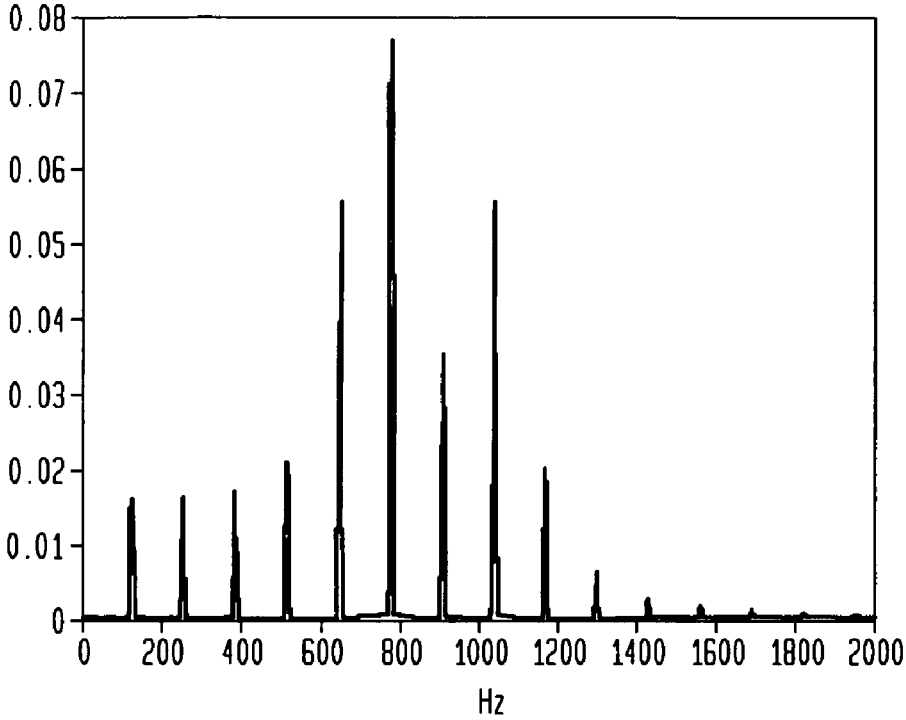
FIG. 3 shows a spectrum graph of the vowel "a" having a fundamental frequency (F0) of 130 Hz, first formant (F1) of 780 Hz and second formant (F2) of 1040 Hz.

In one exemplary embodiment of the present invention there is provided a new filterbank specification to be implemented with speech coding strategies and may emphasize, with high spectral resolution, the speech fundamental or speech harmonics over a specific region or regions. One advantage of such an embodiment may be to increase spectral cues in one or more parts of the processed audio spectrum. In addition, such a filterbank of the present invention may specify the region or regions that are able to resolve increased spectral harmonics from speech signals to allow a prosthetic hearing implant patient to better distinguish different harmonic structures in speech by providing cues to voice-pitch perception, and thus aid tasks such as identification of male/female talker, perception of tonal languages and appreciation of music.

Although an exemplary embodiment will be described in use with prosthetic hearing devices, the present invention may also be used in other stimulating applications that require emphasizing particular spectrums. Examples of prosthetic hearing devices systems are shown in U.S. Pat. Nos. 6,537,200, 6,575,894, and 6,697,674, and PCT Published Application No. WO 02/17679, the entire contents and disclosures of which are hereby incorporated by reference herein. In typical prosthetic hearing implant devices, there may be as many as 22-24 electrodes. Depending on the strategy used, a portion of the 22-24 electrodes may carry a transmitted stimulating signal to the nerves in a cochlea.

Embodiments of the present invention may be used in combination with any speech strategy now or later developed, including but not limited to, Continuous Interleaved Sampling (CIS), Spectral PEAK Extraction (SPEAK), and Advanced Combination Encoders (ACE™). An example of such speech strategies is described in U.S. Pat. No. 5,271,397, the entire contents and disclosures of which is hereby incorporated by reference herein. Embodiments of the present invention may also be used with other speech coding strategies. Preferably, the present invention may be used on Cochlear Limited's Nucleus™ implant system that uses a range of coding strategies alternatives, including SPEAK, ACE™, and CIS. Among other things, these strategies offer a trade-off between temporal and spectral resolution of the coded audio signal by changing the number of frequency channels chosen in the signal path. A typical ACE™ signal path is shown in FIG. 1.

FIG. 1 shows a block diagram of a signal path 100 that is processed by a signal processor 102 that comprises a signal processing module 104 and a series of further signal processing modules 106. Once a signal is processed, signal processor 102 sends the signal to a stimulator controller 108 to activate the electrodes or electrode array (not shown) using stimulating unit 110.

Specifically, a signal is received by a microphone (not shown) and is multiplied by a smoothing window and passed through a filterbank process 112 using a Fast Fourier Transform (FFT) to produce 64 signals for channel combination unit 114 to process. In conventional systems, channel combination unit 114 may be limited by the number of electrodes available in the system, e.g. 22 electrodes. Once channel combination unit 114 combines the number of channels to match the number of electrodes, the processed signal is sent to an equalizer 116 and a maxima extractor unit 118. Maxima extractor unit 118 may extract the largest amplitude channels for stimulating the electrodes according to the speech strategy employed. Once the electrodes are chosen, a mapping unit 120 arranges the signals for stimulating the corresponding electrodes.

For example, with ACE™ on the commercially available SPrint™ speech processor from Cochlear Limited, the number of analysis filter channels may be varied between 6 and 22, depending on the number of electrodes available and the overall requirements for the filterbank. If the frequency range over which these channels are formed remains constant, e.g. 80 Hz-8000 Hz, then a setting of 6 will consist of a set of 6 wide filters while a setting of 22 will consist of a set of 22 considerably narrower filters. In some cases, overlapping filters may also be desirable, such that more filters does not necessarily mean they will be narrower, but "more overlapped" with other filters. It is known that prosthetic hearing implant patients may be able to make use of both spectral and temporal cues with the stimuli presented to their cochlea, and thus the use of wider filters may provide more temporal information.

Certain embodiments of the present invention provide a filterbank that may increase the number of channels to enhance any region of the spectrum where finer spectral detail might be required via many narrow filters. Currently, approximately logarithmic, center frequency spaced filters are typically used in prosthetic hearing implants. An embodiment of the present invention may include a region of high spectral resolution filters within an otherwise logarithmically spaced filterbank. An advantage of the present invention may be to provide more channels in the filterbank path, so that more channels would become available for selection in the following stages of processing, such as maxima extraction. Channel combination unit 114 may be able to increase the number of available channels for selection by post processing modules 106.

The number of channels used in embodiments of the present invention may be more than the number of electrodes present in the system. An additional channel may be placed between each existing electrode channel to emphasis certain regions. For example, an electrode array with 10 electrodes may use 19 channels in processing the audio signal. An increase in the number of channels may allow such embodiments of the present invention to easily accommodate prosthetic hearing implants that have increased numbers of electrodes without any major modifications to the implants.

Alternatively, embodiments of the present invention may use any number of filters and are not limited to the number of electrodes in the system, since any number of intermediate stimulation sites may be created via mechanisms such as described in U.S. Pat. No. 5,649,970 the entire contents and disclosures of which are hereby incorporated by reference.

A filterbank of the present invention may be designed to select a particular harmonic region of the speech spectrum. Any portion of the sound range captured by a prosthetic hearing implant, i.e., approximately 0 Hz to 16000 Hz, may be selected by embodiments of the present invention. The selected portion of the speech spectrum may be divided according to formants, i.e., large concentrations of energy in speech, in particular which together determine the characteristic quality of a vowel sound. Examples of regions to select may be the F1 region of speech, approximately 300 Hz to 1000 Hz, or a subset of this region, e.g., 400 Hz to 800 Hz. Another region to select may be F2 region of speech, approximately 850 Hz to 2500 Hz. Additionally, embodiments of the present invention may be extended to the fundamental frequency range that would target the F0 region of speech, approximately 80 Hz to 400 Hz. In addition, multiple portions or non-consecutive ranges, i.e., 400 Hz to 700 Hz and 1000 Hz to 1500 may be selected.

Any type of filterbank construction now or later developed may be used, such as FIR, IIR or FFT if implemented in a Digital Signal Processor (DSP). With increasing numbers of channels, it often becomes more efficient to use a FFT. In addition, a dual FFT structure may be used where the high resolution FFT covers the 400 Hz-800 Hz frequency region and a low resolution FFT covers the remaining spectrum.

A filterbank of the present invention may be based on a dual FFT filterbank. The first FFT, low resolution, may have a wide filter (128 pt) and operates over the full audio input bandwidth, which is 0-8 kHz. The second FFT, high resolution, may be narrower filter (256 pt) and operates over the 0-4 kHz band. The second FFT provides four times increased resolution for low frequencies compared to standard ACE™ based on a single 128 pt FFT, assuming a 16 kHz sample rate.

FIG. 2 shows a modification of speech processing module 104 in accordance with an embodiment of the present invention. FIG. 2 shows a block diagram of a dual FFT filterbank 202. Both low resolution FFT 204 and high resolution FFT 206 operate on an input buffer of ADC samples from a signal 208. Low resolution FFT 204 requires an audio samples at Fs (16 kHz). Low resolution FFT 204 uses a window function w1(n) 210 and a 128 pt FFT 212. A delay 211 or buffer may be used in low resolution FFT 204. A channel combination unit 214 uses bins 216 that contain mostly high frequency bins, while bins 218 that are not used are discarded. High resolution FFT 206 requires an audio sample at Fs/2 (8 kHz). A low pass filter (LPF) 220 is used to achieve the audio sample for high resolution 206 and then filtered signal is down sampled or decimated by 2 in process 221. High resolution FFT 206 uses a window function w2(*n*) 222 and a 256 pt FFT 224. Channel combination unit 214 uses bins 226 that contain mostly low frequency bins.

Because the high resolution 256 pt FFT 206 filterbank requires twice as many samples at half the Fs sample rate, there may be a processing latency of four times the low resolution 128 pt FFT 204 filterbank. To allow more time to align the low 204 and high resolution FFTs 206, a FIFO delay 211 (or other similar buffering operation) may be used before the low resolution 128 pt FFT 204 window function, since the high resolution 256 pt FFT 206 will be approximately 12 ms behind. The 12 ms delay results from processing delay through the high resolution path, which in this example is 16 ms, less the processing delay though the low resolution path, which is 4 ms. The exact length of the FIFO is dependant on the implementation, including the delay through the down sampling low pass filter (LPF) 220. This filter could be an IIR or FIR.

Figure 4:
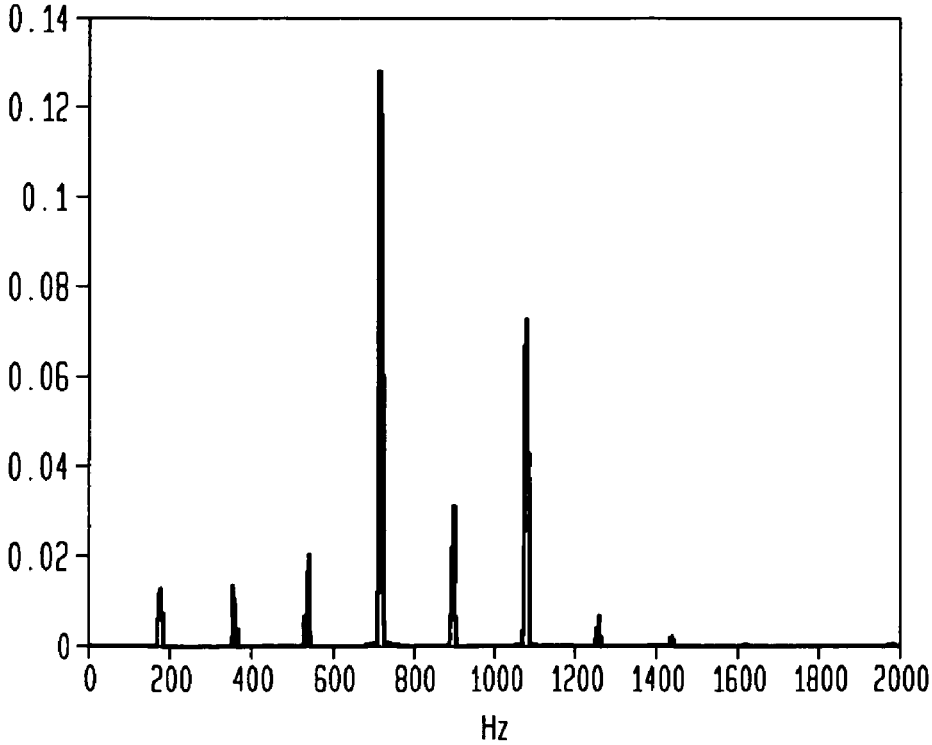
FIG. 4 shows a spectrum graph of the vowel "a" having a fundamental frequency (F0) of 180 Hz, first formant (F1) of 720 Hz and second formant (F2) of 1080 Hz.

It is illustrative to look at the spectrums of the two synthetic vowels, identical except for fundamental frequency. The two vowels are both "a", with the first having a fundamental frequency of 130 Hz and the second having a fundamental frequency of 180 Hz, both typical speech fundamentals, are shown in FIG. 3 and FIG. 4, respectively. The spacing of each harmonic in the spectrum is given by the fundamental (in this case, 130 or 180 Hz), since vowels are periodic signals.

Figure 5:
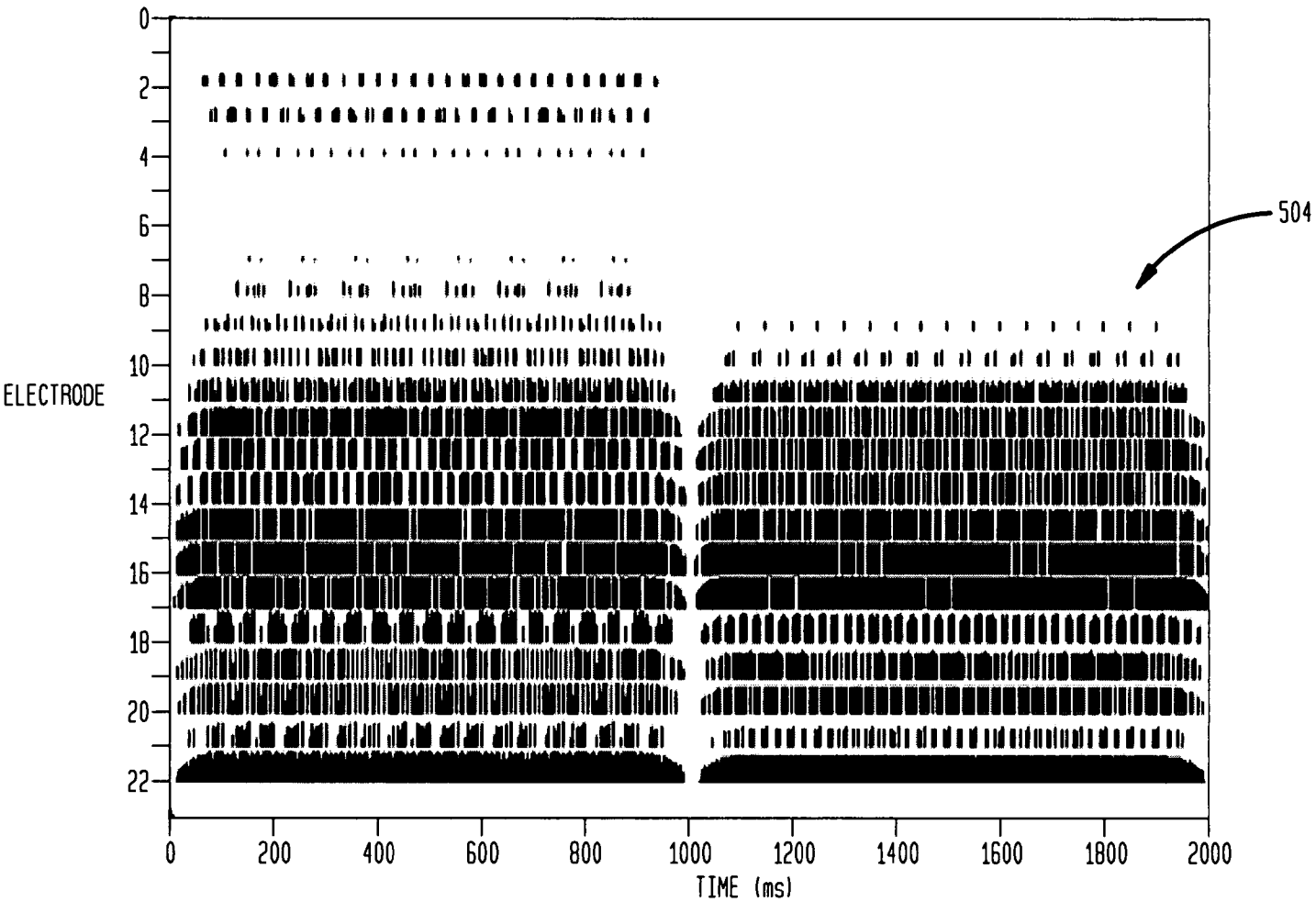
FIG. 5 shows a stimulating graph of 22 electrodes of the processed vowel in FIGS. 2 and 3 using a conventional speech processor.

In conventional speech strategy processing, such as ACE™ on the SPrint™ speech processor, available from Cochlear Limited, filters are typically of the order 180 Hz wide, spaced for example at center frequencies 250 Hz, 375 Hz, and 500 Hz, etc. The 180 Hz spacing and overlap between filters means that the change in the vowel fundamental by 50 Hz and the resultant harmonic spacing does not have much of a change in the energy coming out of each ACE™ filter, which results in audio stimulation. This is shown in FIG. 5, which shows the two vowel spectrums of FIGS. 3 and 4 processed through ACE™ via the Nucleus™ Matlab™ Toolbox (NMT) to produce an Electrodogram. Electrodograms plot stimulus intensity per channel as a function of time. Time is shown along the abscissa and electrode number along the vertex. For each stimulus pulse generated by the device, a vertical bar is shown in the Electrodogram at the time and electrode position of the stimulus. The height of the vertical bar represents the stimulus level (log current in clinical units) where minimum amplitude corresponds to threshold, and maximum amplitude corresponds to comfortable level.

In FIG. 5, display 502 is the "a" vowel of FIG. 3 with a fundamental frequency of 130 Hz, and a display 504 is the "a" vowel of FIG. 4 with a fundamental of 180 Hz. FIG. 5 shows the intensity of the stimulation over each electrode versus time. The height of each segment in each horizontal channel gives the stimulus level. As shown in FIG. 5, there is a small difference between the height of the stimuli of the two vowels in each display. In this case, spectral resolution, which determines which channel is being stimulated, is low. Therefore, in order to resolve different harmonics, the patient must use temporal fluctuations per channel in order to differentiate each vowel sound in conventional speech processing systems.

Embodiments of the present invention may provide an improved spectral resolution by providing many narrow filters in regions of high harmonic energy. In general, for segments of voiced speech, one or more filters in this region will have a relatively large amount of energy in them, while one or more other nearby filters will have relatively little energy in them. Using more filters in regions of relatively large amounts of energy allows the present invention to gives an emphasised cue of the spectral content of a particular region of the speech spectrum.

Using the Nucleus™ Matlab™ Toolbox (NMT), it is possible to examine what happens when spectral resolution is increased with a common prosthetic implant processing strategy, such as ACE™.

Figure 6:
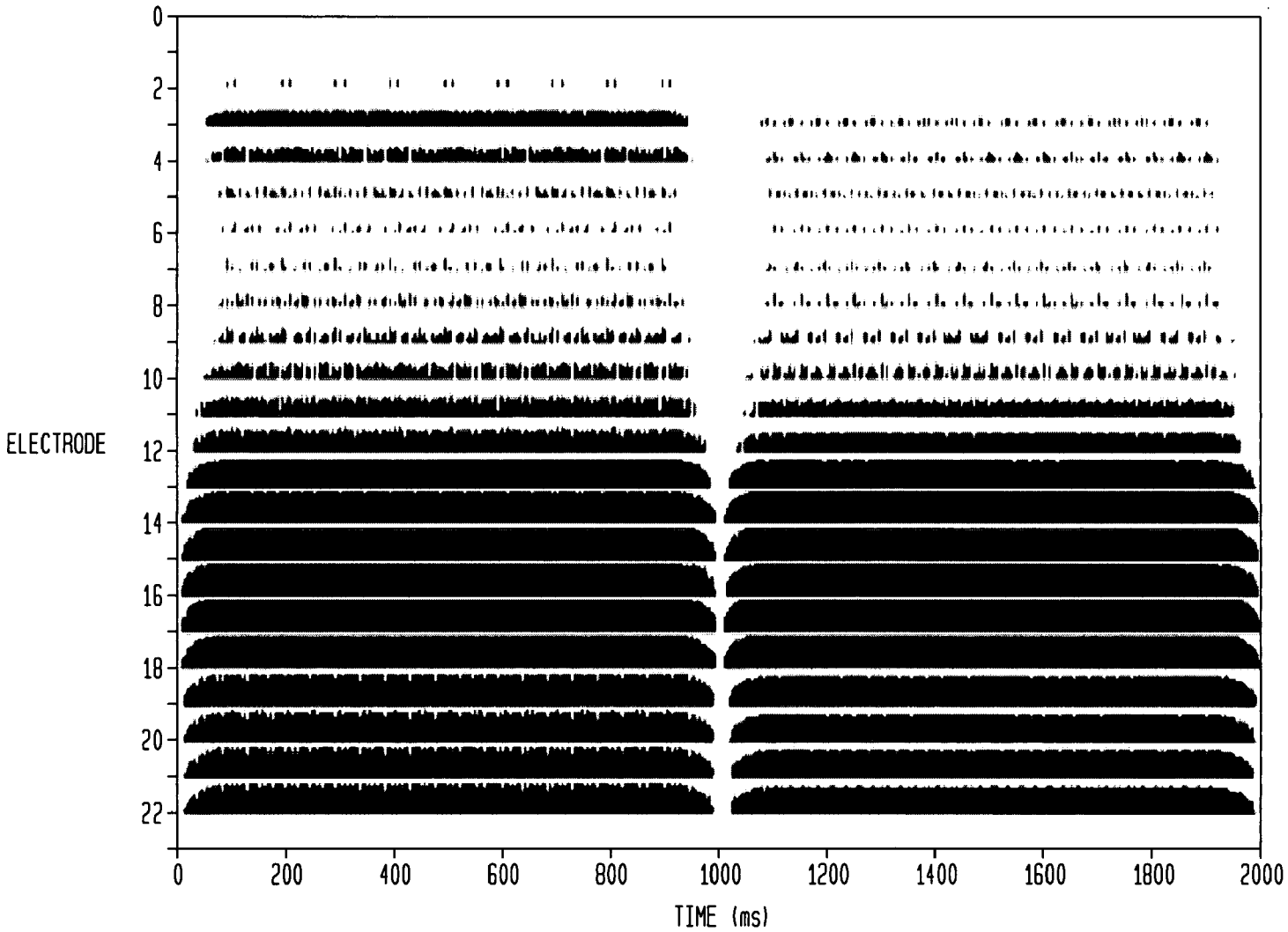
FIG. 6 shows a stimulating graph of 22 electrodes of the processed vowel in FIGS. 2 and 3 using a 128 pt filterbank.
Figure 7:
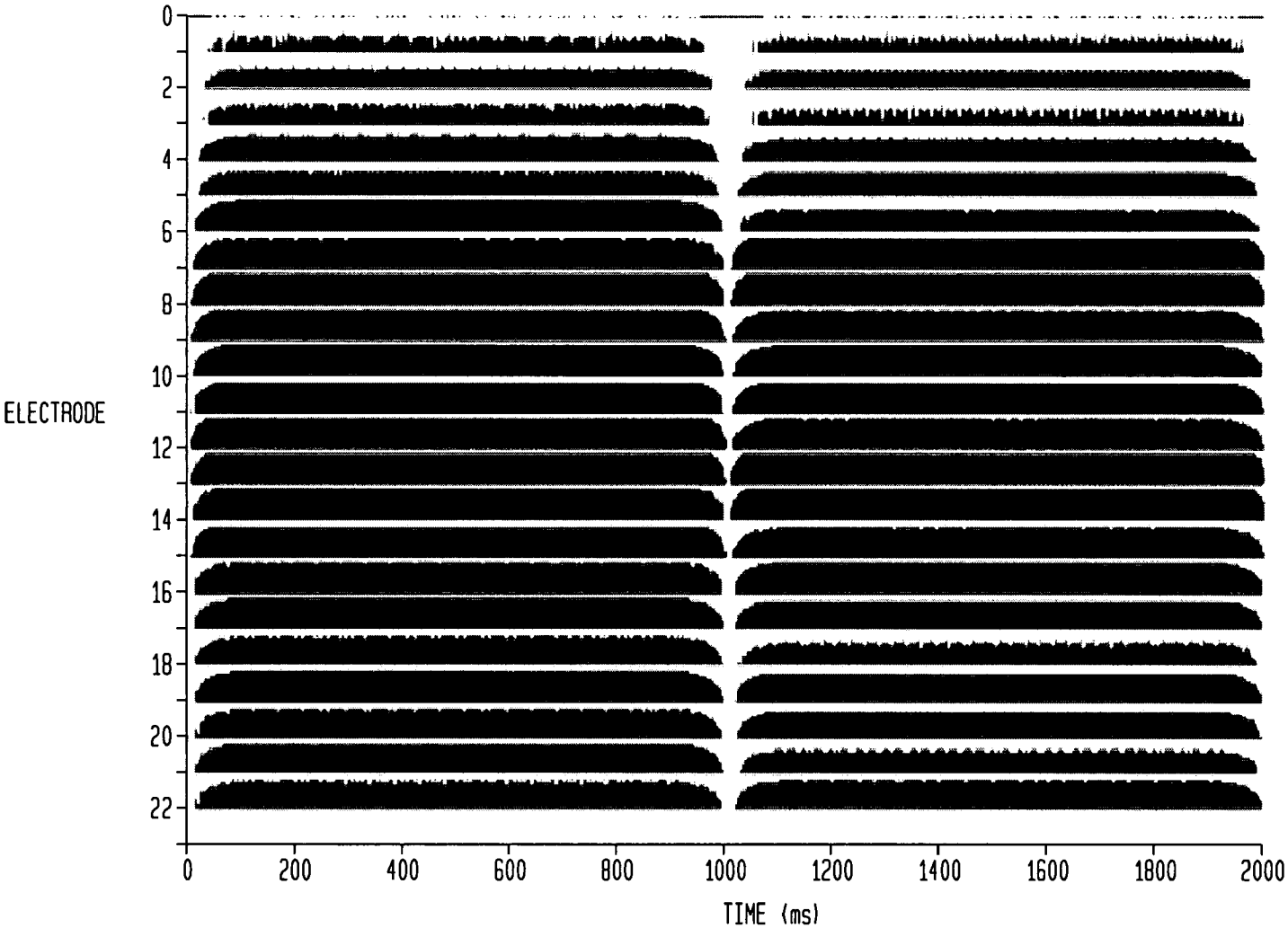
FIG. 7 shows a stimulating graph of 22 electrodes of the processed vowel in FIGS. 2 and 3 using a 256 pt filterbank.
Figure 8:
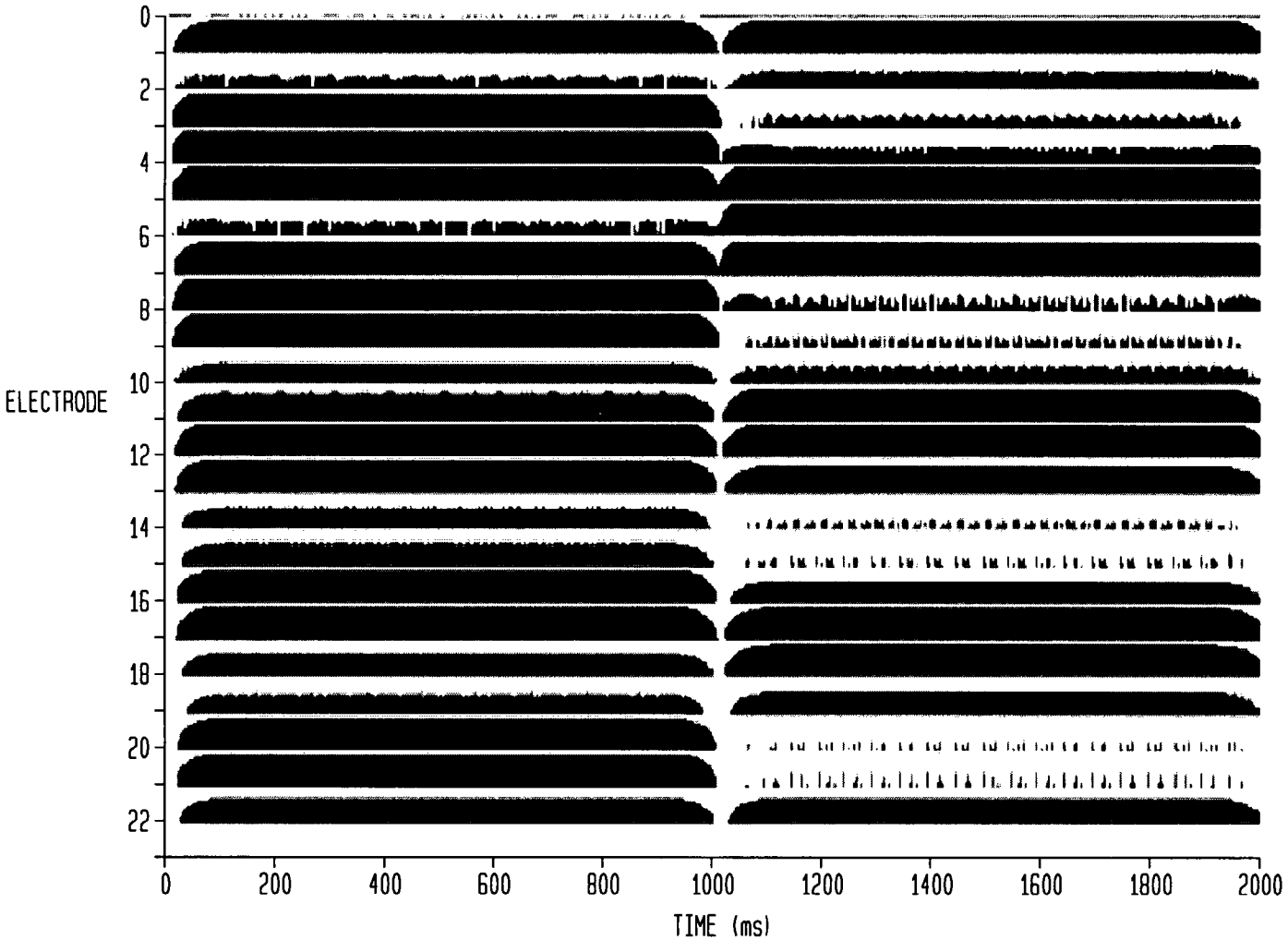
FIG. 8 shows a stimulating graph of 22 electrodes of the processed vowel in FIGS. 2 and 3 using a 512 pt filterbank.

The same two vowels "a" with different fundamentals, as shown in FIGS. 3 and 4 are processed with a modified ACE™ strategy, using an FFT filterbank of single bin spacing 125 Hz, 62.5 Hz and 31.25 Hz, corresponding to a 16000 Hz bandwidth 128 pt, 256 pt and 512 pt FFT, and show in FIGS. 6, 7 and 8, respectively. In FIGS. 6, 7 and 8, the first display, from approximately 0 ms to 1000 ms, represents the output from sampling the sound in FIG. 3, while the second display, from approximately 1000 ms to 2000 ms represents the output from sampling the sound in FIG. 4. Outputs for a selection of 22 FFT bins starting at the same bin centre frequency are shown for comparison. A hamming window was used before the FFT. The plots show the actual output stimulation current levels that would be applied to the cochlea with these filterbank spacings. The lowest channel of each plot is set to be the same frequency, in this case approx 250 Hz. Note the frequency information differences on the Y axis, due to the different bin spacing.

The greatest spectral discrimination between fundamental frequencies for each vowel is given by the last filterbank, as shown in FIG. 8, which has the filter spacing and bandwidth narrow enough to provide one or more filters with relatively large amount of energy, while one or more other nearby filters have relatively little energy in them. The 256 pt FFT bin spacing in FIG. 6 at 16000 Hz sampling rate shows relatively no spectral differences over the 128 pt FFT bin spacing in FIG. 7 at the same sampling rate.

Embodiments of the present invention enhances the spectral cues, such as those shown in FIGS. 6, 7 and 8, to define the region and filters necessary to increase harmonic resolution.

EXAMPLE 1

One example of an implementation of a filterbank for a prosthetic implant speech processor may define a region where the analyze of spectral harmonics with channel spacing equal to or better than the 512 pt FFT, as shown in FIG. 8, is desired.

A specific implementation of the concept is defined for use in a cochlear implant system using a defined region of 400 Hz to 800 Hz as the target region for the increased resolution. This region carries considerable F1 ($1^{st}$) formant energy for typical voiced speech. The total number of filters used is 43, i.e., one additional channel in between each existing electrode channel in the Nucleus® 24 system (22+21 in between=43). Since there is a desire for the higher frequency resolution in a particular region of the spectrum (400 Hz to 800 Hz), wider filters can be used above and below this region, such as a logarithmically spaced fashion normal with ACE™. Two wider filters are chosen to cover the F0 region, below 400 Hz, and approximately log spaced filters following a shifted version of the natural characteristic cochlea filters are chosen above 800 Hz. The total number of filters, including the high resolution ones, is 43.

Figure 9:
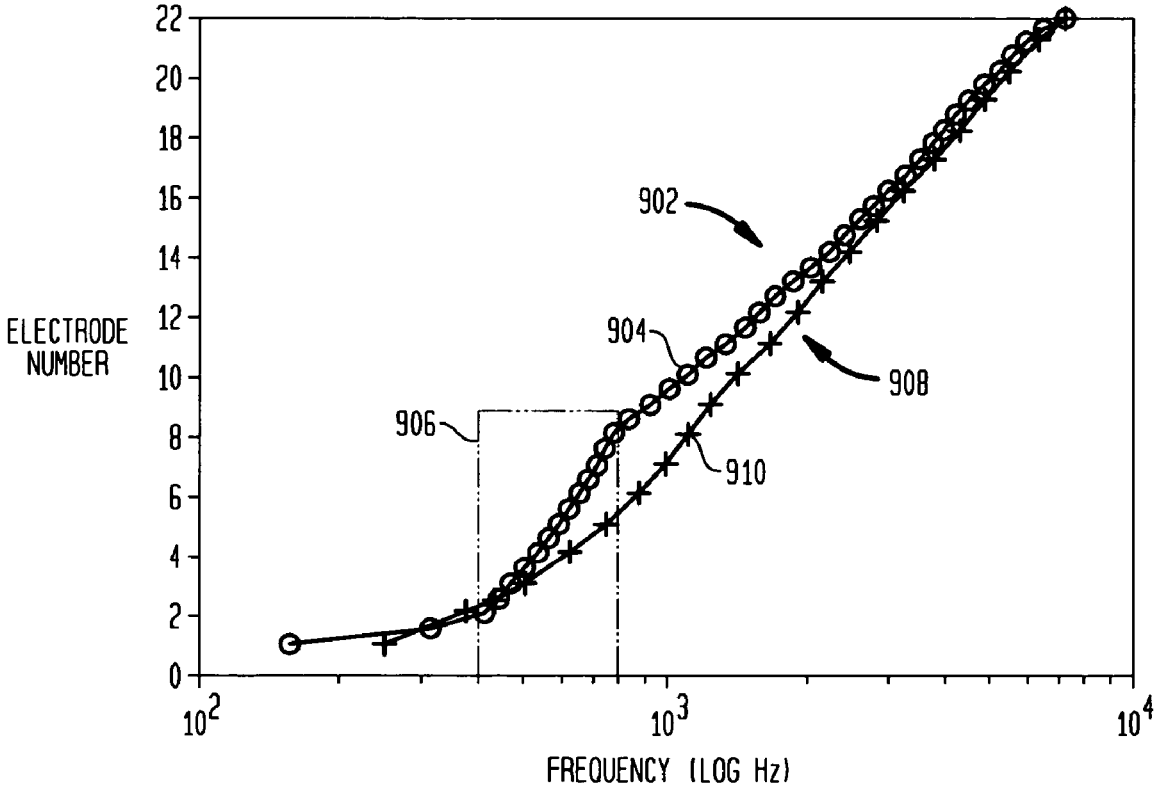
FIG. 9 shows a graph comparing channels of an embodiment of the present invention with the channels of a conventional speech processor.

A center frequency plot of an embodiment of the present invention, namely a Harmonic Emphasis Filterbank (HEF), is compared to a SPrint™ ACE™ filterbank as shown in FIG. 9. FIG. 9 shows the channel selection or number of filters of the present example in comparison with the channel allocation of a conventional SPrint™ FAT 6. Plot 902 shows the present example and has more channels 904 within a F1 subset region 906 than plot 908, which represents the conventional SPrint™ FAT 6. Two channels 904 on plot 902 are shown below F1 subset region 906, fourteen channels 904 are shown within F1 subset region 906 and twenty-seven channels 904 are shown above F1 subset region 906. In comparison, two channels 910 on plot 908 are shown below F1 subset region 906, four channels 910 are shown within F1 subset region 906 and sixteen channels 910 are shown above F1 subset region 906.

As shown in FIG. 9, in the F1 subset region there are filters equivalent to single bins of a 512 pt FFT, each of the high resolution channels is spaced 31.25 Hz apart. A Hanning (cosine squared) window may be used in the high frequency resolution processing path to provide an equivalent filter bandwidth of 45 Hz in each single bin filter. Embodiments of the present invention are able to obtain four times the resolution of standard ACE™, at 180 Hz.

Figure 10:
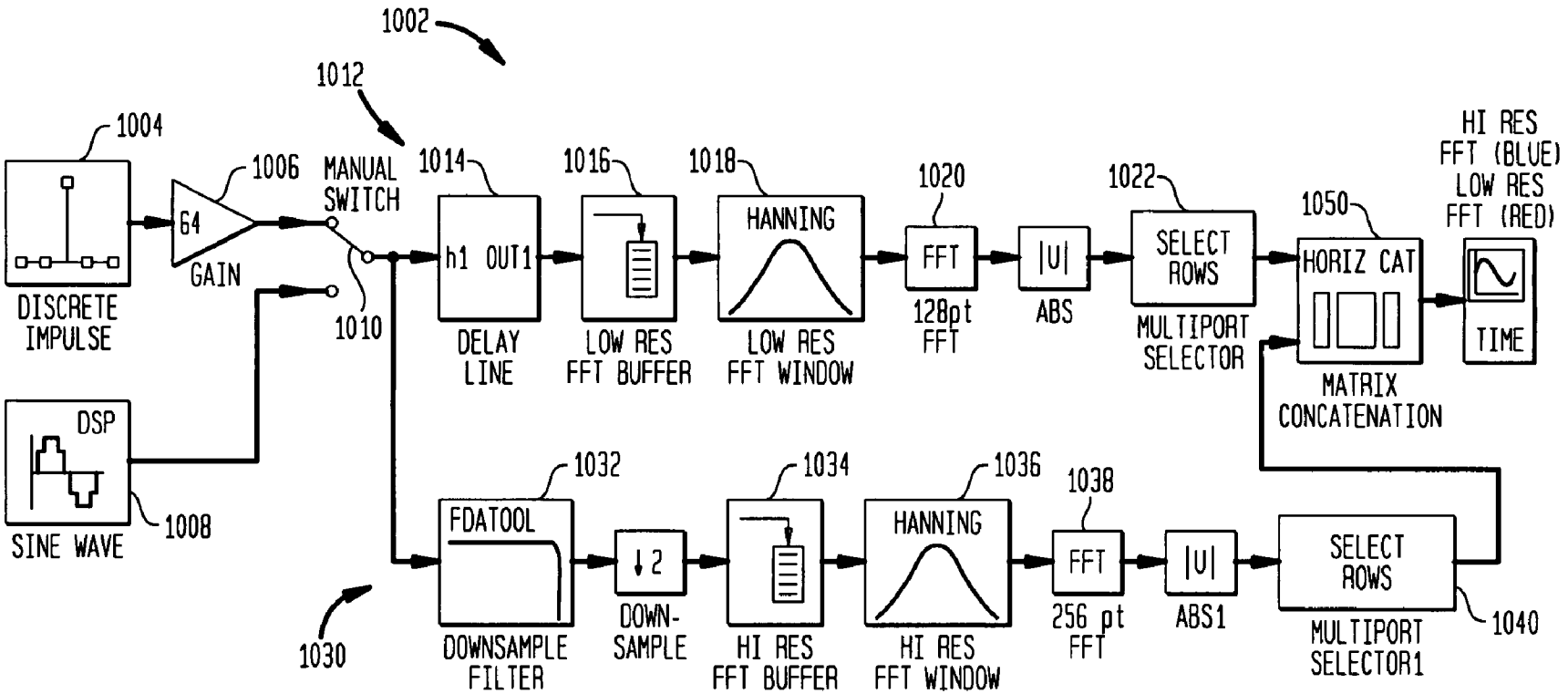
FIG. 10 shows a block diagram of a dual filterbank according to one example of an embodiment of the present invention.
Figure 11A:
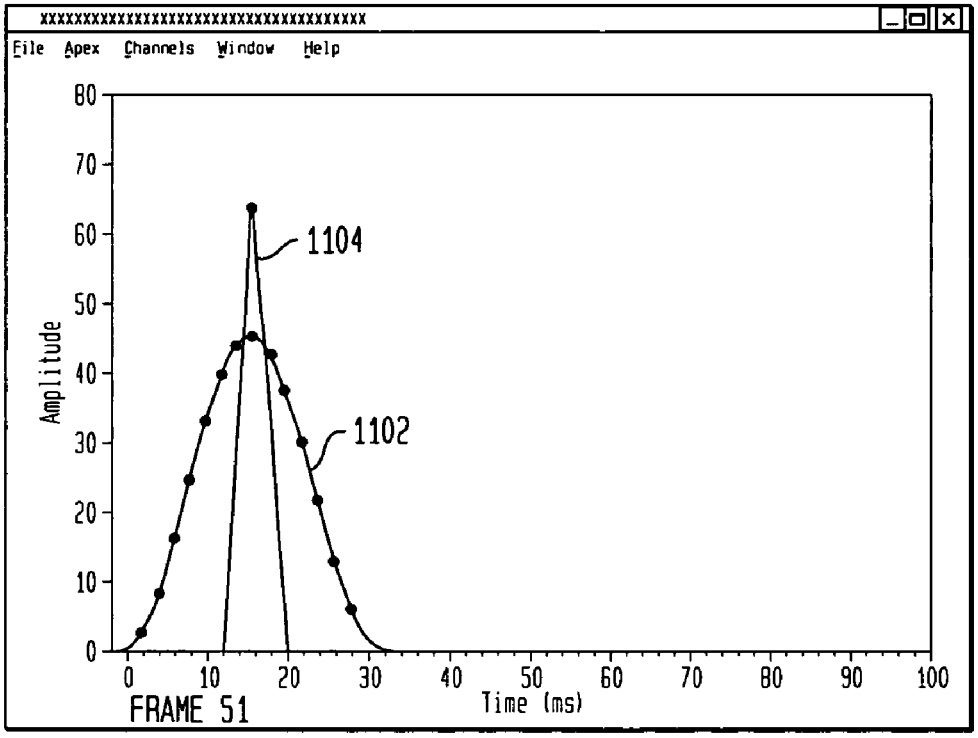
FIGS. 11A and 11B shows a chart comparing the high resolution output with the low resolution output of the dual filterbank shown in FIG. 10.
Figure 11B:
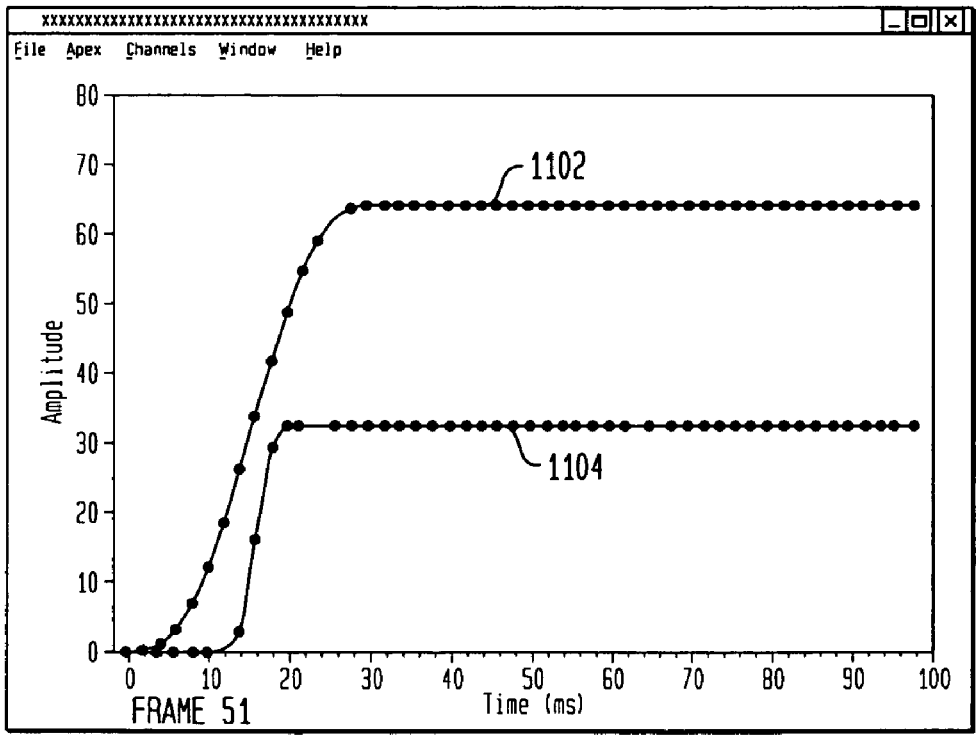

Computer simulating software, such Simulink™, was used to represent an example of a dual FFT 1002 constructed in accordance with the present invention. As shown in FIG. 10, a discrete impulse 1004 with gain 1006 or a sine wave 1008 may be used by dual FFT 1002 by using a switch 1010. Low resolution FFT 1012 processes the signal using a delay line 1014 and buffer 1016 before a window function 1018 and a 128 pt FFT 1020. The absolute value block of processed signal is used to extract the FFT bin magnitude and sent to a multiport selector 1022 that selects any desired row for bin information. High resolution FFT 1030 process the signal using a 45 low pass filter 1032 and down samples by 2. Next a buffer 1034 is used before a window function 1036 and a 256 pt FFT 1038. The absolute value of processed signal is sent to a multiport selector 1040 that selects the rows for bin information. Computer simulator uses a matrix concatenation 1050 and outputs the sampled values. The Simulink model can be used to demonstrate a method to time align the low and high resolution paths, by aligning the impulse and/or step responses of the two paths. This model required for example a delay line of 224 samples to time align the impulse and step responses, which are shown in FIGS. 11A and 1B, respectively. The high resolution response is shown by plot 1102 and the low resolution response is shown by plot 104.

Figure 12A:
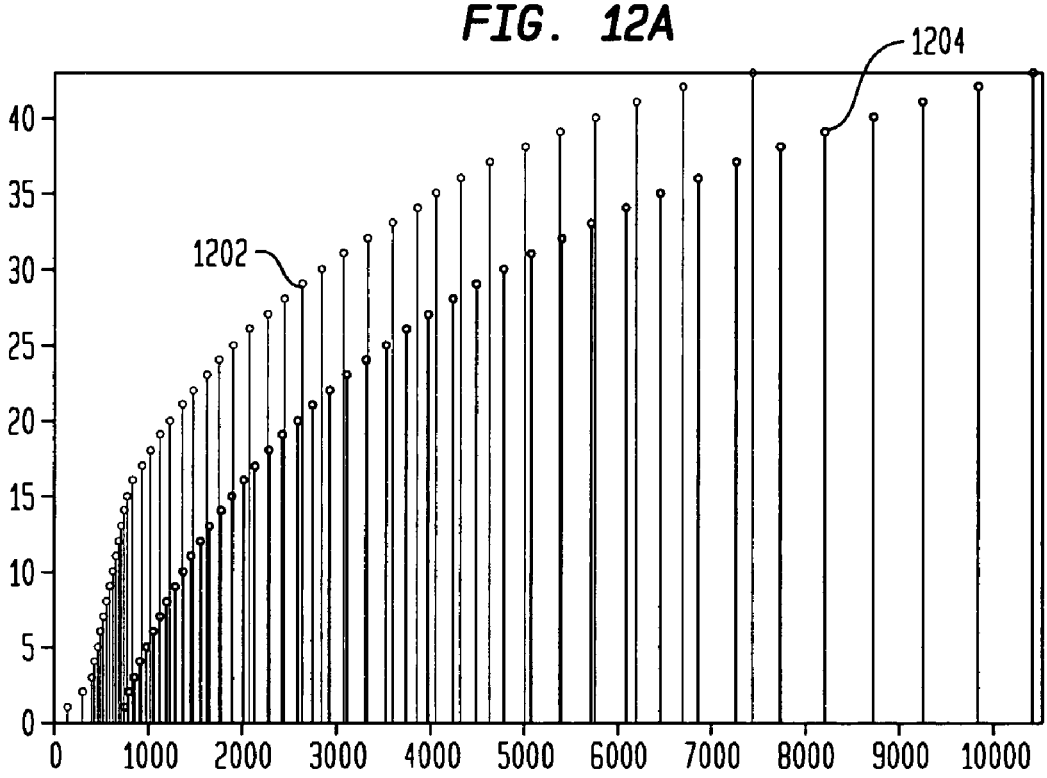
FIG. 12A shows a chart comparing the channel intensity of an embodiment of the present invention with a conventional speech processor.
Figure 12B:
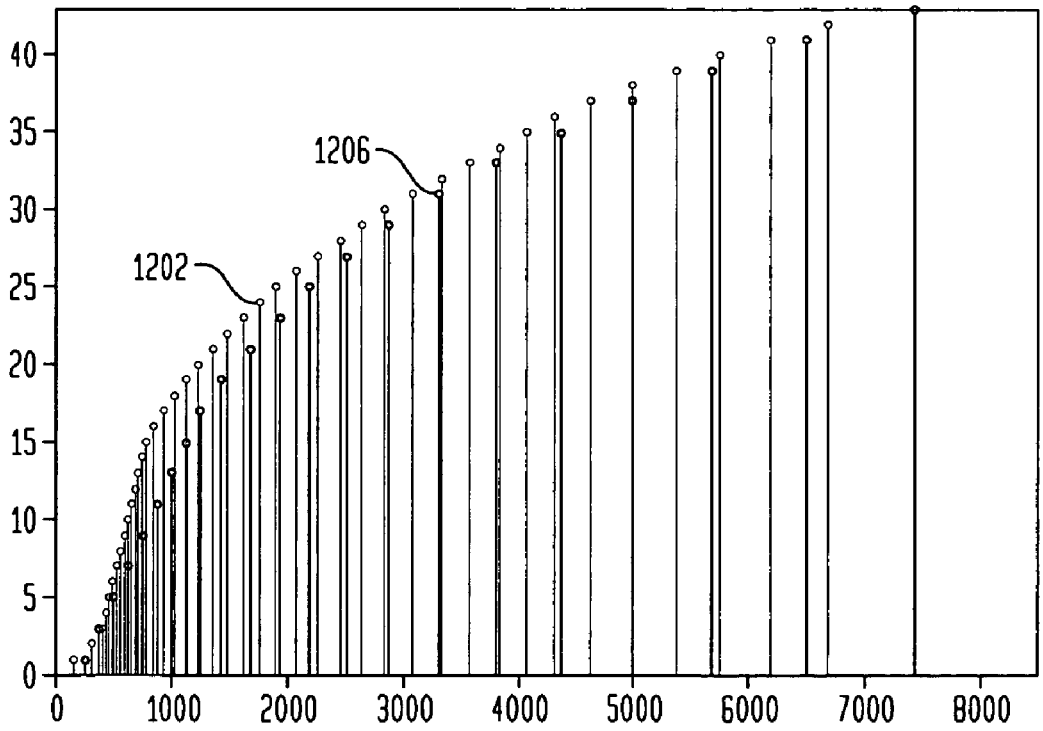
FIG. 12B shows a chart comparing the channel intensity of an embodiment of the present invention with a SPrint™ Frequency Allocation Table (FAT)

The magnitude output from the low and high resolution FFTs may be made available as a dual buffer of values representing the energy in each bin of each FFT. A Frequency Allocation Table (FAT) may be arbitrarily constructed to make use of any bins (either single or combined) for the required filterbank. FIGS. 12A and 12B compare a FAT of the present invention with a FAT of a Contour™ Electrode Chart in FIG. 12A, and SPrint™ FAT 6 in FIG. 12B. Lines 1202 represent the outputs of the present invention, while 1204 represents the outputs of Contour™ and 1206 the outputs of SPrint™ FAT 6.

The following example used a bin allocation table for the use of the two FFT outputs as shown in the table illustrated in FIGS. 13A-13J. The bins used in the FIG. 13A-J table may be optimized with different embodiments and examples of the present invention. In particular, the availability of the upper frequency bins from the high resolution FFT may depend on the LPF cutoff and filter shape, and so should be adjusted accordingly. The first and second columns are the low (128 pt) and high (256 pt) resolution FFTs bin centre frequencies, respectively. The fourth column shows which bins are grouped into a channel, using the FFT (1=low or 2=high resolution) in the third column. For example, channel 1 consists of 5 bins from the high resolution 256 pt FFT from the 93.75 Hz bin to the 218.75 Hz bin inclusive, and so on for all other channels.

Although the present invention has been fully described in conjunction with the certain embodiment thereof with reference to the accompanying drawings, it is to be understood that various changes and modifications may be apparent to those skilled in the art. For example, embodiments of the present invention have been described in connection with a prosthetic hearing device. As noted, the present invention may be implemented in any electrical stimulating device now or later developed.

What is claimed is:

1. A method for processing sound signals for use in a hearing prosthesis, the method comprising:

receiving a signal representative of a sound signal over a frequency range;

applying a first filter bank, having a relatively higher spectral resolution, to a first selected region or regions of said frequency range to produce a first set of a plurality of substantially equally spaced channel outputs;

applying a second filter bank, having a relatively lower spectral resolution, to a second selected region or regions of said frequency range to produce a second set of a plurality of substantially equally spaced channel outputs; and combining the first and second sets of channel outputs, and processing the combined outputs so as to produce a set of stimulation signals for said hearing prosthesis;

wherein the spacing of the second set of channel outputs is greater than the spacing of the first set of channel outputs.

2. The method of claim 1, further including the step of receiving the stimulation signal at a stimulator unit, and delivering corresponding stimuli to a user.

3. The method of claim 1, further including the step of delaying the second set of channel outputs for a predetermined period before combining it with the first set of channel outputs.

4. The method of claim 1, wherein the first filter bank includes a relatively larger number of filter channels.

5. The method of claim 1, wherein the selected region or regions correspond to parts of the frequency spectrum important to speech perception.

6. The method of claim 5, wherein the selected regions correspond to formants.

7. The method of claim 1, wherein the selected region or regions is selected from one or more of the following frequency ranges: 80-400 Hz, 300-1000 Hz, and 850-2500 Hz.

8. The method of claim 7, wherein the selected region or regions are a subset of one of the frequency ranges.

9. The method of claim 1, wherein first and second filter banks are part of the same filter bank.

10. A hearing prosthesis comprising:

receiver means for receiving a signal representative of a sound signal over a frequency range;

a first filter bank, having a relatively higher resolution, adapted to process said received signal and produce a first set of a plurality of substantially equally spaced channel outputs relating to a first selected region or regions of said frequency range;

a second filter bank having a relatively lower resolution, adapted to process said received signal and produce a second set of a plurality of substantially equally spaced channel outputs relating to at least a second region or regions of said frequency range; and combination means to combine the first and second sets of channel outputs, and processing means operative upon the combined outputs so as to produce a set of stimulation signals for said hearing prosthesis;

wherein the spacing of the second set of channel outputs is greater than the spacing of the first set of channel outputs.

11. The prosthesis of claim 10, further comprising: delay means for delaying the second set of channel outputs for a predetermined period before delivering it to said combination means.

12. The prosthesis of claim 11, wherein the first filter bank includes a relatively larger number of filter channels.

13. The prosthesis of claim 10, wherein the selected region or regions correspond to parts of the frequency spectrum important to speech perception.

14. The prosthesis of claim 13, wherein the selected regions correspond to formants.

15. The prosthesis of claim 10, wherein the selected region or regions is selected from one or more of the following frequency ranges: 80-400 Hz, 300-1000 Hz, and 850-2500Hz.

16. The prosthesis of claim 15, wherein the selected one or more regions is a subset of one of the frequency ranges.

* * * * *